United States Patent [19]

Dean et al.

[11] 4,427,537

[45] Jan. 24, 1984

[54] METHOD AND MEANS FOR PREPARING AND DISPERSING ATOMED HYDROCARBON WITH FLUID CATALYST PARTICLES IN A REACTOR ZONE

[76] Inventors: Robert R. Dean, #1 Columbine La., Littleton, Colo. 80123; Jean L. Mauleon, 15656 E. Grand Ave., Aurora, Colo. 80112; Robert J. Newman, 8586 E. Otero Cir., Englewood, Colo. 80112

[21] Appl. No.: 359,157

[22] Filed: Mar. 17, 1982

[51] Int. Cl.[3] ..... C10G 11/18

[52] U.S. Cl. ..... 208/120; 208/113; 208/157; 208/153; 422/140

[58] Field of Search ..... 208/113, 153, 157, 120; 422/140

[56] References Cited

U.S. PATENT DOCUMENTS

| | | | |
|---|---|---|---|
| 2,937,988 | 5/1960 | Polack | 208/157 X |
| 2,952,619 | 9/1960 | Metrailer et al. | 208/157 |
| 3,071,540 | 1/1963 | McMahon et al. | 208/157 X |
| 3,152,065 | 10/1964 | Sharp et al. | 208/157 |
| 3,246,960 | 4/1961 | Sharp et al. | 208/153 X |
| 3,607,730 | 9/1971 | Pfeiffer | 208/153 X |
| 3,654,140 | 4/1972 | Griffel et al. | 208/113 |
| 4,097,243 | 6/1978 | Bartholic | 208/113 X |
| 4,259,175 | 3/1981 | McArthur | 208/113 |
| 4,332,673 | 6/1982 | Myers | 208/113 X |

OTHER PUBLICATIONS

Perry, "Chemical Engineer's Handbook", 5th ed., McGraw Hill, 1973, pp. 18-58 to 18-65.

*Primary Examiner*—Delbert E. Gantz
*Assistant Examiner*—Glenn A. Caldaralar
*Attorney, Agent, or Firm*—Carl D. Farnsworth

[57] ABSTRACT

The invention described is concerned with atomizing an oil fraction of crude oil to provide a fog of oil droplets in diluent gaseous material which is sprayed into an upwardly flowing annular dense mass of catalyst particles to form a high temperature suspension therewith and conveyed through a riser conversion zone under selected hydrocarbon conversion conditions suitable for cracking the oil droplets to gasoline and light cycle oil boiling range products. The oil feed preparation and distribution arrangement to form a suspension with catalyst particles of desired elevated temperature is employed in combination with a two-stage catalyst regeneration operation designed and operated to achieve catalyst temperatures at least equal to the pseudo-critical temperature of the oil feed and at least above the end boiling point of gas oil boiling range material and resid product of vacuum distillation.

7 Claims, 5 Drawing Figures

METHOD AND MEANS FOR PREPARING AND DISPERSING ATOMED HYDROCARBON WITH FLUID CATALYST PARTICLES IN A REACTOR ZONE

This invention relates to the catalytic conversion of hyrocarbons with fluid particles of catalyst by method and means selected to improve the operation and yields of desired products. More particularly the present invention is concerned with identifying operating parameters with implementing means for particularly promoting atomized-vaporized contact of a heavy oil feed with dispersed phase particles of catalyst under conditions whereby deleterious coking, carbon formation and desired product losses are minimized. In yet another aspect this invention is concerned with the conversion of high boiling hydrocarbons such as gas oils, residual oils, reduced crudes, topped crudes, whole crudes, residual oil portions of crude oils comprising metallo-organic compounds, shale oils, oil products of tar sands and oil products of coal conversion and mixtures thereof.

The present invention is directed in one particular aspect to an improved feed atomizing method and injection means for obtaining intimate atomized oil feed contact with finely divided fluid catalyst particles of relatively high surface area and catalytic cracking activity contributed by one or more crystalline zeolite materials comprising the catalyst particles. Crystalline zeolites suitable for the purpose are identified in the prior art and include ultra stable and rare earth exchanged crystalline zeolites of large and smaller pore volume. In the prior art of U.S. Pat. No. 3,547,805 the hydrocarbon oil feed is charged to the system by injecting it as an annulus surrounding a stream of water. This system is concerned with atomizing the oil feed and mixing it with steam.

U.S. Pat. No. 3,152,065 discloses feed injector arrangements which include an inner pipe for passing steam and an outer pipe forming an annulus for passing oil feed which is mixed in a smaller diameter opening in the end of the outer pipe displaced apart from the open end of the inner steam pipe. The patent also discloses placing curved stator vanes in the annulus adjacent the end of the steam pipe. The feed nozzle combination may be used in the bottom of a riser or in the wall of the riser above the catalyst inlet thereto.

Figure 1:
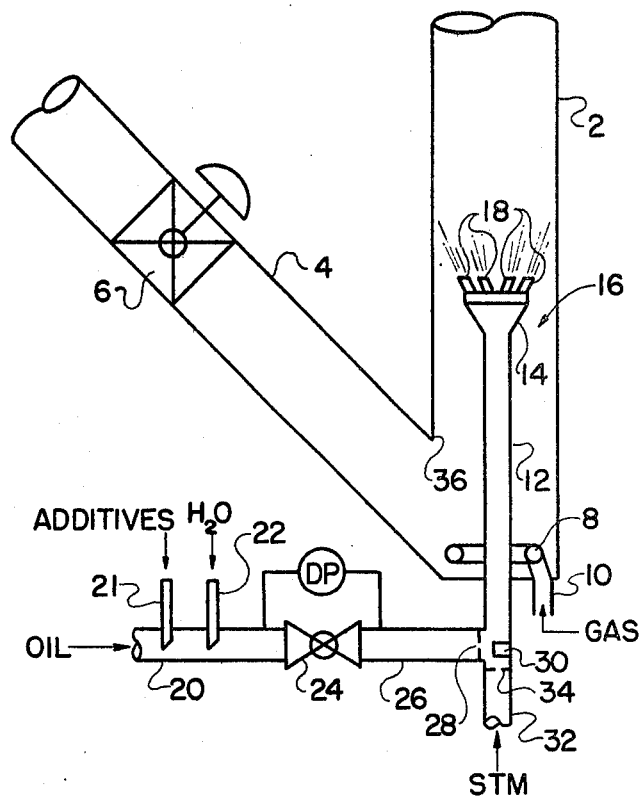
Figure 2:
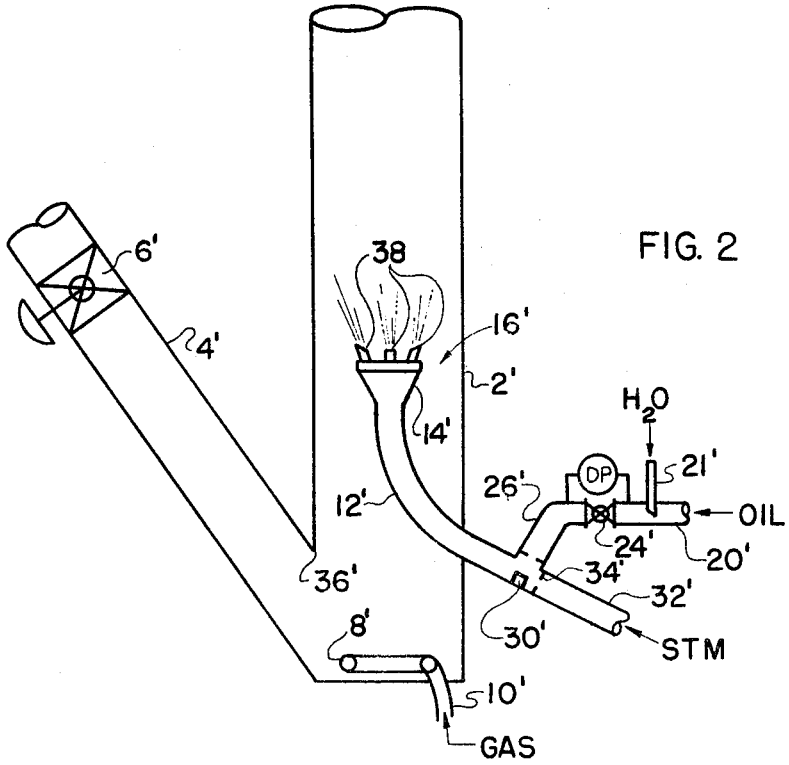
Figure 3:
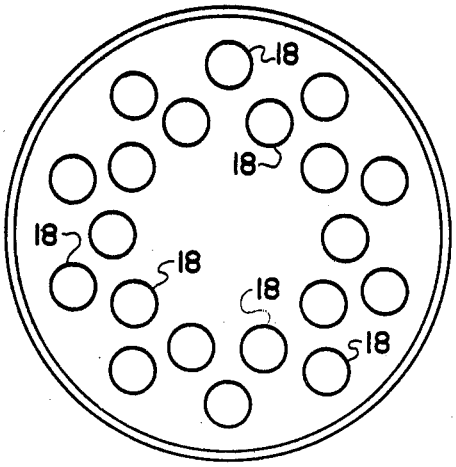
Figure 4:
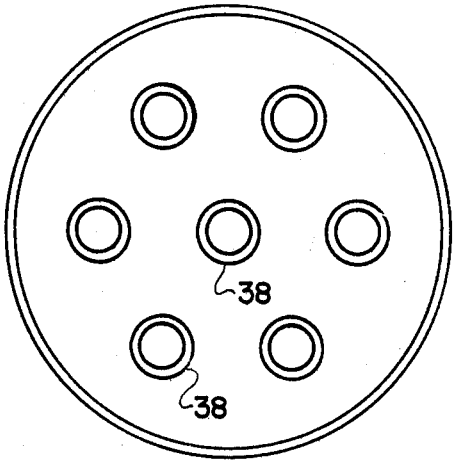
Figure 5:
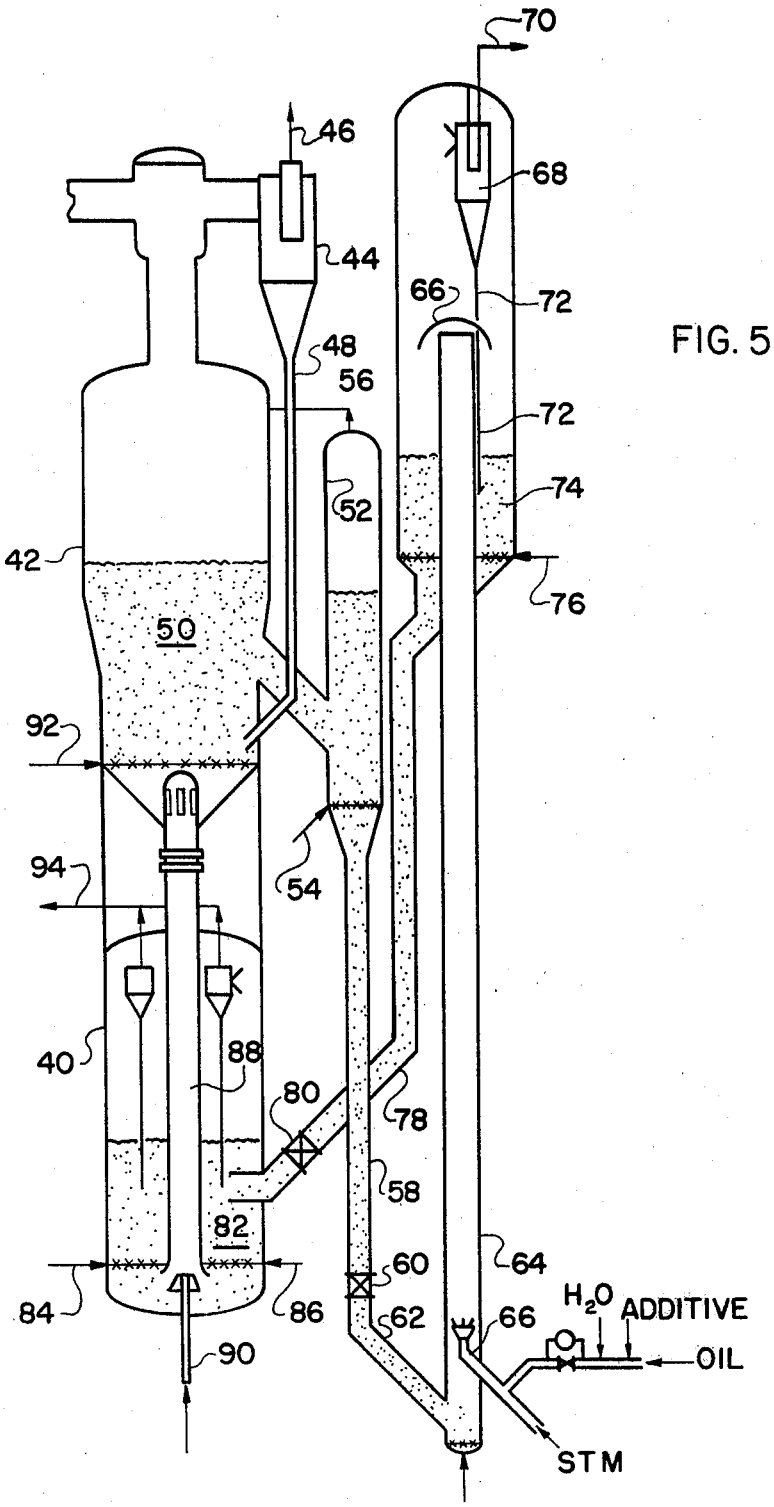

U.S. Pat. No. 3,654,140 is directed to a novel cat cracking oil feed injector design concurrently feeding steam to the injection zone in a volumetric ratio of steam to liquid hydrocarbons ranging from about 3 to 75, thereby imparting to the resulting mixture an exit velocity relative to the fluidized catalyst of at least about 100 feet per second whereby the oil feed stock is essentially completely atomized at the nozzle exit forming droplets less than about 350 microns in diameter. The nozzle exit of each of FIGS. 1 and 2 are shown extended a substantial distance into the reaction zone where upflowing dispersed phase catalyst can be attrited and erode the nozzle end.

U.S. Pat. No. 3,812,029 contemplates a nozzle arrangement similar to U.S. Pat. No. 3,071,540 except that the outer tube is used to inject water at a temperature end flow rate lower than that of oil feed in the center tube. An article in the Oil and Gas Journal for Mar. 30, 1981 entitled, "Burst of Advances Enhance Cat Cracking", by D. F. Tolen, review in considerable detail problems facing modern day refiners processing residual oils comprising metal contaminants and Conradson carbon producing components boiling above vacuum gas oils. The subjects briefly discussed include catalysts suitable for resid cracking in the presence of metal contaminants; the effect of metal contaminants on product selectivity; the addition of steam and/or water with the feed; catalyst regeneration; feed quality; combustion promoters used in regeneration of the catalyst to obtain desired regeneration temperature profiles and problems associated with sulfur and nitrogen oxides.

This article further identifies the need to obtain good mixing of the feed with catalyst in a riser reactor. In this catalytic-hydrocarbon conversion environment, good mixing is said to reduce gas make, increase gasoline selectivity, and improve catalytic cracking in preference to thermal cracking and reduce carbon formation.

The above identified operating parameters are intended to also accelerate the mixture relatively uniformly within the feed vaporization section of a riser reactor in a minimum time frame and thus enhance rapid heat transfer from hot catalyst particles to charged feed preferably atomized and thus prevent localized enhanced catalyst to oil ratios contributing to a dense catalyst bed phase. That is, the operating conditions and methods for implementing are selected to ensure a relatively dilute phase suspension contact between catalyst particles and atomized oil feed for vaporized conversion transfer through a riser conversion zone. Such dilute catalyst phase operations include catalyst particle concentrations in the range of 0.5 to 10 pounds per cubic foot and preferably not above about 5 pounds per cubic foot.

SUMMARY OF THE INVENTION

The present invention is concerned with providing an improved combination of operating parameters and means for achieving intimate high temperature contact between an atomized-vaporized oil feed diluent mixture with fluid particles of active cracking catalyst in a conversion zone under selected conditions of temperature, hydrocarbon-catalyst ratio, contact time between oil feed and catalyst, catalyst activity and hydrocarbon partial pressure selected to obtain desired selective cracking of the oil feed to gasoline product. The oil feed processed by the operating parameters and means herein identified comprise gas oil boiling range hydrocarbons with or without metallo-organic compounds and substantial Conradson carbon producing components boiling above about 1025° F.

In the combination of oil feed atomization, catalytic conversion thereof and regeneration of catalyst particles so used as provided by this invention, a high boiling oil feed of at least 600° F. initial boiling point and of a gravity in the range of from about 5 to about 28 API gravity is atomized as herein provided and brought in intimate contact with an upflowing annular mass of hot catalyst particles in a fluidizing medium. A reactor temperature of at least 1000° F. and sufficient to obtain substantially instantaneous vaporization of the atomized oil feed and catalytic conversion thereof is contemplated in one embodiment under substantially plug flow dispersed catalyst phase conversion conditions in a down stream portion of a riser conversion zone. Conversion of the oil is restricted to a contact time in the riser within the range of about 0.5 up to 6 seconds and more usually less than about 3 or 4 seconds is a particularly preferred embodiment. The operating modes contemplated and suspension relationships between oil feed, catalyst particles and diluent material are selected to provide a relatively dispersed catalyst phase suspension comprising a particle concentration within the range of about 0.5 up to about 10 pounds of catalyst particles per cubic foot of riser conversion zone following dispersion in atomized oil feed. It is known by those skilled in the art that the concentration of catalyst particles in an upflowing suspension may be varied considerably by the velocity and volume of fluidizing gasiform material in the presence thereof in addition to the volume changes obtained by hydrocarbon conversion products obtained in the riser.

The method of operation contemplated by this invention also includes the formation of an oil feed-water emulsion comprising up to about 5 weight percent of water and preheated up to about 800° F. which is atomized as herein described before dispersion into an upflowing stream of catalyst particles. It is particularly desirable to avoid thermal cracking of the atomized oil feed admixed with diluent material before contact with catalyst particles. Therefore, the atomized oil feed is formed preferably external to a riser reaction zone and transferred through conduit means housed for example in a heat dissipating sleeve as required which is purged with gasiform material such as steam, dry gas, $CO_2$ or other suitable gaseous material.

The unique and special oil feed preparation device of this invention comprising an oil atomizing section, an atomized oil transfer section and a distribution or dispersion head for the atomized oil feed within a riser contact zone may be employed in one of several different arrangements as discussed below. That is a barrel or conduit of the nozzle system may extend through the bottom of the riser on the riser axis or penetrate the riser wall with a straight or curved conduit means with or without a heat dissipating sleeve means above identified. The atomized oil droplets within the range of about 10 to about 500 microns resembling a mist or fog of oil droplets in a diluent medium is discharged by a plurality of nozzles in a confined system more fully discussed below at velocities from 25 feet per second up to and including sonic velocities. The diluent medium used to atomize the oil feed and fluidize particles of catalyst as herein provided may be relatively inert or one which will enter into the cracking reaction to reduce or promote hydrogen production, hydrogen transfer reactions, and deactivate to some extent accumulated metals on catalyst particles. The catalyst is preferably recovered from catalyst regeneration at a temperature usually above about 1400° F. up to as high as 1800° F. by the method and means of copending application 169086 filed July 15, 1980 and incorporated herein by reference thereto. Thus, the hydrocarbon conversion temperature employed is selected to form an atomized oil feed-diluent-catalyst particle suspension mixture of sufficiently high temperature to accomplish vaporization of the oil feed and conversion of the feed during traverse of a riser reactor. Separation of the suspension at the riser discharge is accomplished at a temperature sufficiently elevated to optimize recovery of vaporous hydrocarbon products of catalytic conversion. Suspension temperatures at the riser discharge within the range of about 900° up to about 1400° F. are contemplated, but will depend upon the particular feed processed.

The method and means for preparing a high boiling oil feed for dispersion contact with fluid particles of catalyst according to this invention is one designed to particularly atomize an oilwater emulsion into fine oil droplets in the range of 10 to 500 microns and preferably sufficiently small droplets to form a oil droplet fog or mist of oil droplets in diluent material such as steam, normally gaseous hydrocarbons, $CO_2$ and combinations thereof. Thus the oil feed or a water emulsion thereof is initially formed into relatively small droplets and the droplets thus formed are sheared with a relatively high velocity stream of gaseous material to form smaller size droplets less than 500 microns to produce a fog or mist thereof. The sheared oil droplets in gaseous diluent are then conveyed to a dispersion head coaxially positioned within a hydrocarbon conversion zone about which an upflowing relatively low velocity mass of catalyst particles pass as a relatively dense fluid mass of catalyst particles. Thus in a specific arrangement comprising a riser conversion zone, a dense fluid bed mass of relatively hot regenerated catalyst particles is caused to flow upwardly through a bottom portion of a riser conversion zone and about an atomized oil feed distribution chamber provided with a plurality of nozzle means in the upper surface thereof for dispersing the atomized oil feed in contact with catalyst particles passing between the riser wall and the distribution chamber as an annular relatively dense fluid upflowing catalyst mass whereby a dispersed phase suspension of catalyst particles and atomized-vaporized oil feed with diluent material is initiated for continuous upward flow through the upper portion of the riser conversion under essentially plug flow dispersed phase hydrocarbon conversion conditions.

When dispersing atomized oil droplets as a fog or mist in contact with hot particles of catalyst to form a suspension therewith, the oil droplet does not necessarily need to come in direct contact with hot catalyst particles to obtain rapid vaporization thereof. In this environment, heat flows rapidly by thermal conduction from the hot catalyst particles to the atomized oil droplets and rapidly if not instantaneously vaporizes the fine liquid droplets to improve cracking contact with particles of catalyst. Therefore when converting oil feed comprising high boiling vacuum gas oils and higher boiling components of crude oils, it is important to form the suspension as herein provided at a temperature equal to or above the end boiling point of the oil feed or at least equal to or above the pseudo critical temperature of the oil feed in the event its end boiling point is not easily obtained. Atomization of the oil feed may be accomplished by a number of different means known in the prior art. It is important to this invention however that such atomization be accomplished external to a hydrocarbon conversion zone in the presence of gasiform diluent material to form a fog or mist thereof comprising droplets smaller than 500 microns and thereafter conveying the atomized oil-diluent fog mixture to a dispersion head in the hydrocarbon conversion zone for contact with catalyst particles as herein provided.

The improved riser reactor-oil feed system of this invention takes full advantage of a high activity and selective zeolite containing cracking catalyst employed in the system. The system and method used insures that the catalyst-oil phase is well dispersed and fluidized during conversion or cracking with vaporized oil feed. In addition, the method of operation permits obtaining desired controlled short contact time between oil and catalyst particles in a plug flow type of operation before effecting catalyst-hydrocarbon product separation rapidly at the discharge end of a riser cracking zone.

In one embodiment of this invention, regenerated catalyst enters a bottom portion of the riser conversion zone through a downwardly sloping conduit provided with a catalyst flow control valve above a bottom portion thereof. The catalyst particles thus charged to the riser as a dense mass of particles is mixed with fluidizing and/or fluffing gas charged to a bottom portion of the riser to promote or provide for a smooth non-turbulent change in direction of catalyst flow to an upward relatively low velocity dense flow of catalyst particles toward and about a coaxially position oil feed distribution and injection bowl or pot in the riser resembling a flower pot in cross-section and provided with feed injection nozzles eminating from its upper surface. Multiple feed injection nozzles positioned in a circular pattern provide a smooth, well distributed introduction of the atomized oil feed and diluent material in contact with the upflowing catalyst particles to form a suspension therewith thereby assuring more optimum dispersion and utilization of catalyst particles contributing to more uniform coke deposition.

The distribution and dispersion of atomized-vaporized oil feed in contact with catalyst particles is enhanced considerably by the use of a relatively straight and vertical riser reactor in at least a substantial portion thereof maintained under process flow conditions to minimize slippage between catalyst particles and vaporized hydrocarbons-diluent material in suspension contact therewith. The riser length and volume are predetermined and set to provide relatively optimum yields of gasoline and/or light cycle oil from a given range of oil feed stocks under select unit operating conditions. Optimum operating conditions are maintained within relatively narrow limits by precise and substantially instantaneous riser temperature control. This is achieved by direct regulation of the regenerated catalyst flow in the regenerated catalyst standpipe with a slide valve positioned in a lower portion of the standpipe and adjacent the riser bottom portion and controlled by the riser outlet temperature controller. The regenerated catalyst thus charged to the riser is maintained in a relatively dense phase upflowing condition by fluidizing or fluffing gas charged to the riser bottom portion and beneath the catalyst inlet thereto. The oil feed distribution pot is preferably positioned at an elevation intermediate the regenerated catalyst standpipe flow control valve and the standpipe inlet to the riser reactor. In any event it is positioned sufficiently above the regenerated catalyst standpipe inlet to be in a region of relatively smooth upward flow of catalyst.

Undesired prolonged dilute phase cracking of the charged oil feed in the riser is maintained at a very low order of magnitude by using highly efficient cyclones adjacent to the riser outlet. In a specific embodiment not shown they are attached to radiating conduit means which may be straight or curved to coincide with tangential attachment to a cyclone. Other means known in the prior art may also be employed for separating the suspension which will accomplish the results desired. A rapid and efficient separation between reaction products of hydrocarbon conversion and catalyst not only improves desired product yields but also reduces catalyst loading entrainment in the main fractionator downstream of the riser reactor.

From the instant of contact between hot catalyst particles and atomized oil vapors in the riser as herein provided, all subsequent conversion (cracking) interactions are complicated because catalyst activity and temperature conditions are constantly changing throughout the length of the riser. Concomitantly with the conversion of a reduced crude there is a significant molar expansion coupled with acceleration of both vapor and catalyst.

In order to fully utilize the intrinsic catalytic activity of zeolite containing catalysts, proper apparatus design is essential to allow intimate mixing at the point of initial contact between hot catalyst particles and atomized oil feed such as a reduced crude is critical. Further, there is desirably provided a uniform distribution of catalyst particles and feed under conditions of minimum back mixing (near plug flow) during the concurrent flow of catalyst particles and vaporous materials through the riser reactor which is substantially vertical in a major portion thereof. Injection of vaporized-atomized feed, rapid vaporization of atomized feed in the riser, increased atomization and dispersion of the feed, use of a plurality of separate and oriented feed nozzles means located in a particular equal area circular arrangement, and use of dispersion steam or other fluidizing gas to control the catalyst flow velocity above the catalyst choke or defluidization point are all aids to improve the mixing of oil feed with catalyst and to minimize the deleterious effects of a dense back mixing catalyst bed above the oil feed injection point. After obtaining initial catalyst/oil contact, relatively dispersed catalyst phase fluidization occurs and the rapid molar expansion of hydrocarbon conversion or cracking causes a sharp increase in vapor velocity, which acceleration of catalyst particles over a few seconds from a relatively low initial velocity to one approaching that of the vaporous material comprising hydrocarbons and fluidizing gaseous material. Although the gas velocity tends to drive individual catalyst particles upward, there are the opposing effects of gravity and inertia, with the result that the velocity of the solid catalyst particles is less than the gas velocity. This difference is known as the "slip velocity". For any section of a riser reactor, the slip ratio S can be defined as the ratio of catalyst residence time/vapor residence time, i.e.:

$$S = \frac{T_c}{T_v} = \frac{V_v}{V_c}$$

where $T_c$=catalyst residence time $T_v$=vapor residence time $V_v$=vapor velocity $V_c$=catalyst velocity It has been observed that after an initial acceleration through approximately 10 feet of the riser, catalyst particle velocity differs from the vapor velocity by an amount approaching the free fall velocity $V_f$, and the following equation holds:

$$S = \frac{V_v}{V_c} = \frac{V_v}{V_v - V_f}$$

High vapor velocities not only reduce the catalyst hold up or slip that occurs in a riser but also allows considerable improvement in catalyst distribution. Radial maldistribution (high localized catalyst concentration at the wall, hence high local C/O ratios) and other aberrations that cause deviations from ideal plug flow are also minimized with high vapor velocities, with catalyst distribution tendering to be more uniform with the extent of vertical displacement up the riser.

FIG. 1 is a diagrammatic sketch in elevation of the lower portion of a riser reactor zone and regenerated catalyst standpipe inlet thereto in relation to the oil feed inlet system of the invention coaxially aligned with and penetrating the bottom cross-section of the riser reactor.

FIG. II is a diagrammatic sketch in elevation of the lower portion of a riser reactor zone and regenerated catalyst standpipe thereto in relation to the oil feed inlet system penetrating the riser reactor wall.

FIG. III is a top view of the circular arrangement of nozzles eminating from the top surface of the oil feed distributor pot of FIG. I.

FIG. IV is a top view of the circular arrangement of nozzles eminating from the top surface of the oil feed distributor pot of FIG. II.

FIG. V is a diagrammatic sketch in elevation of a riser reactor zone in cooperative arrangement with a system of catalyst regeneration comprising two stages of catalyst regeneration stacked one above the other.

DISCUSSION OF SPECIFIC EMBODIMENTS

Referring now to FIG. I by way of example there is shown the bottom or lower portion of a riser reactor zone 2 in association with a regenerated catalyst standpipe 4 provided with a flow control valve 6. An annular gas distributor ring 8 is provided in a bottom portion of riser 2 for introducing and distributing fluffing and fluidizing gaseous material such as $CO_2$, steam, normally gaseous hydrocarbon or a mixture of two or more of such materials by conduit 10 for maintaining catalyst particles charged to the bottom of the riser by standpipe 4 as a generally fluid upflowing smooth dense mass of catalyst particles. This fluidizing gas is charged at a linear velocity in the range of 0.1 to about 0.5 feet per second and thus contributes to achieving smooth turn around of downflowing catalyst particles to an upflowing relatively smooth dense fluid mass of catalyst particles with the rate of catalyst flow up to the feed pot controlled by valve 6 in the catalyst standpipe 4. Thus it is intended to maintain a dense fluid mass of upflowing catalyst particles in the bottom portion of the riser reactor 2 and about the feed inlet conduit 12 terminating in an upper distributor pot 14 and forming an annular passageway 16 with the wall of the riser reactor zone. The top closed surface of pot 14 is provided with a plurality a nozzle means 18 arranged in a circular pattern as shown in FIG. III more fully discussed below. Conduit 12 is provided for passing atomized oil feed and diluent material obtained as herein provided to the distributor pot and nozzles for spraying the atomized oil fog into contact with upflowing catalyst particles in annular section 16 thereby initiating the formation of an upwardly flowing suspension of hydrocarbon feed-diluent-catalyst particles at a desired hydrocarbon conversion temperature. One method for forming the atomized oil feed as herein desired is to charge an oil stream by conduit 20 to which may be added viscosity reducing additives by conduit 21 and water by conduit 22. From 1 to 5 weight percent of process water may be added by conduit 22. Conduits 20 and 22 comprising probe means inserted into conduit 20 may comprise an elongated slot in the downstream side of the probe to aid with mixing of the materials added with the oil feed and form an emulsion. The oil water mixture is then passed through flow control valve 24 permitting a pressure drop over the range of 5 to 20 psig. The oil feed is then passed by conduit 26 to an orifice restriction 28 of desired size which will direct a stream of the oil against a solid surface means 30 to form droplets of oil by impingement. A gaseous material such as steam or other suitable gaseous material herein identified is charged in an amount within the range of 1 to 10 weight percent by conduit 32 and passed through orifice restriction 34 before shearing contact with formed oil droplets and formed as above discussed to achieve a further atomization of the oil feed and form a fog or mist comprising oil droplets in the range of 10 to 500 microns. The atomized oil-diluent fog mixture thus formed is conveyed by conduit 12 to distributor pot 14. Conduit 12 may be surrounded by a heat dissipating sleeve not shown and purged with gaseous material to remove particles of catalyst and heat from the annular space between the sleeve and conduit 12. In the arrangement above discussed the pot 14 is positioned above the catalyst standpipe inlet a sufficient distance to assure dense fluid catalyst phase movement up the riser to the annular space about distributor pot 14. In a specific embodiment the distributor pot is located about three riser diameters above the upper surface contact of conduit 4 with the wall of riser 2 at point 36 to assure the smooth catalyst flow desired.

The arrangement of FIG. II is similar to that of FIG. I except that conduit 12' is shown curved and penetrates the wall of riser 2' preferably above the regenerated catalyst standpipe inlet so that the mass of catalyst particles in the riser between annular section 16' and ring 8' is in an upflowing dense fluid catalyst phase condition. Inlet conduit 12' terminates in a distributor pot 14' provided with feed injection nozzles in the upper closed surface thereof. In this specific arrangement the nozzles are arranged as shown in the top view of FIG. IV. However, in either FIG. I or FIG. II the arrangement of nozzles employed may be either of that shown in FIGS. III and IV. The apparatus arrangement of FIG. II thus is used in a manner similar to that discussed with FIG. I except for the changes above noted. In either of these arrangements the fluidizing gas charged by ring 8 or 8' is sufficient to achieve a linear superficial velocity at least equivalent to the minimum fluidization velocity of the catalyst employed and generally in the range of about 0.1 to about 0.5 feet per second.

FIG. III diagrammatically shows a nozzle 18 arrangement or pattern which may be employed with the atomized oil distributor pot 14 of either FIG. I or II. In this arrangement equal numbers of nozzles 18 are equally spaced but staggered with respect to one another on two different diameter circles. The nozzles are sloped generally outwardly from the riser axis an amount sufficient to permit oil contact with the wall of the riser in the absence of catalyst flow not less than 4 feet above the upper surface level of the distribution pot.

FIG. IV departs from the nozzle arrangement pattern of FIG. III in that a much smaller number of larger diameter nozzles 38 are employed on a single diameter circle in conjunction with an axially located nozzle. The plan views of FIGS. III and IV are interchangeable in the arrangements of FIGS. I and II. Also more or less nozzles may be employed in either of these arrangements which will improve vaporized oil contact with catalyst particles.

In the nozzle arrangement of FIG. III, the arrangement is designed to achieve a hollow spray of atomized oil feed in diluent material which has to be penetrated by upflowing particles of catalyst to form a desired high temperature suspension mixture thereof. This method of contact appears to provide a more even contact between atomized and vaporized oil feed and inhibits substantially if not completely, catalyst and coke accumulation on the wall of the riser. The nozzle arrangement of either FIG. III or IV are positioned on the upper surface of a distributor pot of a size and shape providing little restriction to desired catalyst particle flow thereabout. Thus, the cross-sectional area of the annular section between the distributor pot and the riser wall should not be less than the cross-sectional area of the catalyst standpipe and preferably is greater than the standpipe cross-sectional area. Thus the pot 14 of FIG. I may occupy from 20 to about 40 percent of the riser cross-sectional area with minimum effect on desired upward flow of catalyst particles. In addition, as above suggested, the distributor pot is located on a plane below the regenerated catalyst standpipe flow control valve to reserve the static head achieved by the standpipe catalyst and dense fluid mass of catalyst in the bottom portion of the riser beneath the distributor pot. The distributor pot 14 is ideally designed and shaped to minimize catalyst flow disturbance upwardly and about the pot to optimize mixing of oil droplets, diluent and catalyst. This is achieved by employing a distributor pot derived from a cone with a 30 degree apex. To achieve desired nozzle exit velocity, it is proposed to pass an atomized oil-diluent mixture through the conduit to the distributor pot at a linear velocity preferably not exceeding more than half of the desired nozzle exit velocity. Thus the atomized and vaporized oil-diluent mixture passed through conduit 12 of FIG. I at a velocity of about 150 feet per second would be discharged from provided nozzles at a velocity of about 300 feet per second in one specific example. Other higher and lower velocity parameters may be employed with success depending on the feed processed.

It has been postulated here before in the prior art that the liquid oil outlet velocity should match the superficial velocity of the vaporized uncracked oil material in the riser reactor. It has been observed recently, however, that in fact the feed inlet velocity can be much higher than previously thought possible and up to as high as about 350 or 400 feet per second without encountering any noticeable adverse effects on the operation since the atomized oil feed expands extremely rapidly due to pressure drop and substantially instantaneously upon discharge in the riser cross-section. It has been further observed that a diluent such as steam in the atomized oil feed should be injected at a rate high enough to at least fluid support the catalyst particles and the velocity may be as low as 6 feet per second based on riser cross-section without adverse effects.

Referring now to FIG. V by way of example there is shown an arrangement of apparatus particularly suitable for using and accruing the results of the improved operating concepts of this invention. That is to say, a two-stage regeneration operation is provided which permits obtaining high temperature catalyst particles by effecting the second stage of regeneration at a higher temperature than employed in a first stage operation in the manner taught in copending application Ser. No. 169086 filed July 15, 1980 and now allowed. In this apparatus arrangement of FIG. V there is shown two separate regeneration zones 40 and 42 stacked one above the other with the lowermost zone 40 comprising a first-stage of dense catalyst bed regeneration and the uppermost zone 42 comprising the second stage of dense catalyst bed regeneration. The upper regeneration zone is refractory lined to withstand temperatures above 1400° F. and more usually at least 1500° or 1600° F. during dense fluid bed regeneration of catalyst particles to remove residual coke from the catalyst with oxygen containing regeneration gas. Hot $CO_2$ rich flue gases with entrained particles of catalyst are removed from the top of regenerator 42 by a "T" shaped refractory lined conduit means and provided with cyclone separating means on the end of each radiating arm of the "T". There may be 2, 3 or 4 radiating arms provided for this purpose. The hot $CO_2$ rich flue gases are separated from entrained catalyst fines in a refractory lined cyclone separating zone 44 from which flue gases are recovered by conduit 46. Separated catalyst fines are recycled to the regenerator by dipleg 48. High temperature regenerated catalyst in the range of 1400° to 1800° F. is withdrawn from bed 50 and passed on to a stripping zone 52 wherein the catalyst is stripped countercurrently with inert stripping gas introduced by conduit 54. Stripping gas is recovered from the stripper by conduit 56 for return to the upper regenerator 42. The hot regenerated catalyst is passed by standpipe 58 to flow control valve 60 and thence by conduit 62 to a bottom portion of riser reactor 64 wherein it is initially retained as an upflowing relatively dense fluid mass of catalyst particles in relatively low velocity fluidizing gaseous material suitable for the purpose. Such gaseous material may be $CO_2$, steam, light normally gaseous hydrocarbons and mixtures of such components. An atomized oil mixture with gaseous diluent obtained as discussed above with respect to either FIG. I or II is charged to a distributor pot by conduit 66 for distribution by nozzle arrangements of either FIG. III or IV and contact with upflowing catalyst as particularly discussed above. The suspension thus formed at a desired elevated hydrocarbon conversion temperature at least equal to and preferably above the end boiling point of the oil feed moves upwardly through the riser under catalytic cracking or conversion temperature conditions for a time generally restricted to less than about 4 seconds before discharge separation at the upper end of the riser contact zone. Means for separating the suspension discharged from the riser may be selected from any one of a number of different arrangements disclosed in the prior art, it being preferred to employ one providing the most efficient separation means. A hood 66 or other suitable arrangement may be positioned over the upper open end of the riser as shown in the drawing or a butterfly-looking appendage may be employed in conjunction with openings in the riser wall as shown in the copending application above identified. On the other hand, the top of the riser may terminate in radiating arms to which cyclone separation means are attached much in the same manner discussed above with respect to flue gas recovery and separation from regenerator 42 but absent not needed refractory lining. In the arrangement of the drawing hydrocarbon vapors and gaseous diluent material initially separated from suspension forming catalyst particles are passed through cyclone separation means represented by cyclone 68 from which vaporous material is recovered by conduit 70 and separated catalyst particles are recovered by dipleg 72 for passage to a collected bed of catalyst 74. Stripping gas such as steam is charged to a lower portion of bed 74 by conduit 76. The stripped catalyst is then conveyed by standpipe 78 to valve 80 and thence to catalyst bed 82 comprising a first stage of catalyst regeneration in regenerator 40. Oxygen containing regeneration gas is charged to a lower portion of bed 82 by conduits 84 and 86. The regeneration of the catalyst is accomplished in bed 82 is one of relatively mild regeneration below about 1400° F. but sufficiently elevated to remove a substantial portion of hydrocarbonaceous deposits of catalytic cracking effected in riser 64. Catalyst thus partially regenerated is conveyed from a lower portion of bed 82 upwardly through a riser conduit 88 with oxygen containing gases such as air introduced by hollow stem plug valve 90 and into a bottom portion of catalyst bed 50. Additional oxygen containing gas may be added to a lower portion of bed 50 by conduit means 92. Flue gas products of catalyst regeneration in 40 are subjected to cyclone separation to remove catalyst fines before recovery by conduit 94. Generally such flue gas will be CO rich because of the operating conditions employed in regenerator 40 and may be used to generate steam or power in downstream equipment not shown.

The operation of a unit design similar to that discussed above with respect to FIG. V has been most successful in that the riser pressure drop has been found to be less than normally experienced heretofore. There is substantially less dry gas and coke make and the pressure drop in the first 10 feet of the riser reactor is less than 50% of the riser pressure drop thereby showing that excellent mixing of atomized oil feed and catalyst particles has been achieved. The improved results of the cracking operation here described are particularly achieved when processing an oil feed with a crystalline zeolite containing catalyst of equilibrium activity employing:

A nozzle exit velocity of 300 feet per second
A riser outlet velocity of 62 feet per second
Feed rate of 18000 BPD
Steam equal to 5 weight percent
C/O ratio of 5.5
A riser pressure drop of 2.0 psig Having thus generally described the improved method and means of this invention and discussed specific embodiments in support thereof, it is to be understood that no undue restrictions are to be imposed by reasons thereof except as defined by the following claims.

We claim:

1. A method for catalytically converting portions of crude oil boiling above 600° F. of API gravity in the range of 5 to 28 with fluid catalyst particles which comprises atomizing a crude oil fraction boiling above 600° F. in the presence of gaseous diluent material to form a fog mixture comprising oil droplets in the range of 100 to 500 microns size external to a riser reaction zone passing the atomized oil-diluent fogged feed mixture through an elongated zone to a feed distributor zone positioned coaxially within the lower portion of an elongated riser reactor zone but above the inlet of catalyst thereto, said distribution zone occupying from 20 to 40 percent of the riser cross section, discharging the atomized-diluent fogged feed mixture through a plurality of separate upwardly extended restricted passageways from the upper surface of said distributor zone generally inclined outwardly from the axis of the riser reaction zone said fogged feed discharged at a velocity in the range of 300 ft./sec. up to sonic velocity, passing a fluid suspension of catalyst particles upwardly through an annular passageway between said feed distributor zone and the wall of the riser reaction zone at an elevated temperature sufficient to convert said discharged atomized oil feed upon contact with the suspended catalyst particles above the distributor zone to form a suspension thereof passing at a velocity sufficient to traverse the riser contact zone within a selected time frame less than 4 seconds and separating the suspension following traverse of the riser reaction zone into a hydrocarbon vaporous product phase and a catalyst phase each separately recovered.

2. The method of claim 1 wherein the plurality of separate restricted passageways are of restricted length and eminate from the upper surface of said distributor zone in one or a plurality of spaced apart circular arrangements.

3. The method of claim 1 wherein the oil feed is a residual component of crude oil comprising metallo-organic compound which is atomized with a gaseous material selected from the group comprising water, steam, $CO_2$, normally gaseous hydrocarbons and combinations thereof to provide a highly atomized oil component in diluent material of less than 500 micron droplet size and heated up to about 800° F. before passage to said distribution zone.

4. The method of claim 1 wherein regenerated catalyst is charged to a bottom portion of the riser zone beneath said feed distribution zone, the charged catalyst is mixed with a fluidizing gas sufficient to form a less dense upflowing fluid catalyst phase in the riser to and through an annular zone between said riser wall and said feed distributor zone.

5. The method of claim 1 wherein the upflowing annular fluid mass of hot catalyst particles intercept atomized oil spray directed outwardly and along the riser axis sufficient to form an upflowing suspension comprising a particle concentration up to about 10 pounds per cubic foot.

6. The method of claim 1 wherein catalyst particles separated from vaporous hydrocarbon products following traverse of the riser cracking zone are passed through a sequence of separate catalyst regeneration zones of increasing temperature in the direction of catalyst flow to provide catalyst particles at a temperature within the range of 1400° F. up to about 1800° F. before recycle to the hydrocarbon conversion riser zone.

7. The method of claim 1 wherein the conversion catalyst employed comprises one or more crystalline zeolite components and at least one zeolite component is an ultra stable catalytically active crystalline zeolite component alone or in combination with a faujasite crystalline zeolite exchanged with rare earths.

* * * * *